US006038802A

United States Patent [19]

Tidwell

[11] Patent Number: 6,038,802

[45] Date of Patent: Mar. 21, 2000

[54] PORTABLE DISPLAY SYSTEM

[76] Inventor: John E. Tidwell, 3804 S. View Cir., Knoxville, Tenn. 37920

[21] Appl. No.: 08/954,420

[22] Filed: Oct. 20, 1997

Related U.S. Application Data

[63] Continuation of application No. 08/645,080, May 13, 1996, abandoned.

[51] Int. Cl.[7] ..... G09F 15/00

[52] U.S. Cl. ..... 40/610; 135/127; 160/377

[58] Field of Search ..... 40/610; 135/126, 135/127, 139, 140, 142, 900, 901, 903; 160/377

[56] References Cited

U.S. PATENT DOCUMENTS

| | | | |
|---|---|---|---|
| 351,990 | 11/1886 | Mansure | 40/610 |
| 2,528,311 | 10/1950 | Hurley . | |
| 2,693,655 | 11/1954 | Tschiedel . | |
| 2,723,817 | 11/1955 | Harwood et al. | 40/610 X |
| 3,041,032 | 6/1962 | Wilcox . | |
| 3,527,434 | 9/1970 | Mauro | 40/610 X |
| 3,640,601 | 2/1972 | Murray . | |
| 3,942,869 | 3/1976 | Portner et al. . | |
| 4,411,085 | 10/1983 | Farmer | 40/610 |
| 4,705,355 | 11/1987 | Espo . | |
| 4,827,958 | 5/1989 | Cantwell et al. | 135/104 |
| 5,308,035 | 5/1994 | Ross . | |
| 5,329,873 | 7/1994 | Tiballi | 40/610 X |
| 5,491,584 | 2/1996 | Schlienger . | |
| 5,551,178 | 9/1996 | Foley et al. | 40/610 |

*Primary Examiner*—Joanne Silbermann
*Assistant Examiner*—Andrea Chop
*Attorney, Agent, or Firm*—Michael E. McKee

[57] ABSTRACT

A display/screen system which is positionable upon a floor and is cooperable with a vertical support surface, such as a wall, includes a sheet of flexible material having an edge and a collapsible frame from which the sheet of material is suspended in a spread condition for use. The frame includes a horizontally-disposable section having two opposite ends and a pair of leg sections which are connectable to the horizontally-disposable section at the opposite ends thereof so as to depend generally downwardly therefrom. The edge of the sheet of material is attachable along the horizontally-disposable section of the frame so that by attaching the edge of the sheet of material to the horizontally-disposable section, positioning the leg sections of the frame upon the floor adjacent the vertical support surface and then leaning the horizontally-disposable section to a position of rest against the vertical support surface, the sheet of material which is attached to the horizontally-disposable section is suspended therefrom in a spread condition adjacent the vertical surface.

6 Claims, 4 Drawing Sheets

PORTABLE DISPLAY SYSTEM

This is a continuation of application Ser. No. 08/645,080, filed May 13, 1996, now abandoned.

BACKGROUND OF THE INVENTION

This invention relates generally to display systems with which images can be displayed and relates, more particularly, to a portable display system, such as a screen system, which can be collapsed to facilitate its transport between sites.

Collapsible screen systems used, for example, for displaying images projected by a projector commonly include a set of tripod legs and a relatively long and heavy casing within which a screen is stored in a wound arrangement. However, the set of tripod legs of such a screen system requires a relatively large amount of floor space when set up for use, and when the system is collapsed to its most compact condition, the system is still relatively large and bulky.

It is an object of the present invention to provide a new and improved display system which can be collapsed to a lightweight and compact condition for ease of transport.

Another object of the present invention is to provide such a system which can be collapsed to a more compact arrangement than conventional systems which employ a casing within which a screen is stored.

Still another object of the present invention is to provide such a system which requires less floor space for set-up than is required by common screen systems which utilize a set of tripod legs.

Yet another object of the present invention is to provide such a system which is uncomplicated in construction and effective in operation.

SUMMARY OF THE INVENTION

This invention resides in a display system which is positionable upon a floor and is cooperable with a vertical support surface, such as a wall.

The display system includes a sheet of flexible material and a collapsible frame with which the sheet of material is suspended in a spread condition for use. The frame includes a horizontally-disposable section having two opposite ends and a pair of leg sections which are connectable to the horizontally-disposable section at the opposite ends thereof so as to extend generally downwardly therefrom. The sheet of material is attachable to the horizontally-disposable section of the frame so that by attaching the sheet of material to the horizontally-disposable section, positioning the leg sections of the frame upon the floor adjacent the vertical support surface and then leaning the horizontally-disposable section to a position of rest against the vertical support surface, the sheet of material which is attached to the horizontally-disposable section is suspended therefrom in a spread condition adjacent the vertical surface.

DETAILED DESCRIPTION OF THE ILLUSTRATED EMBODIMENTS

Figure 1:
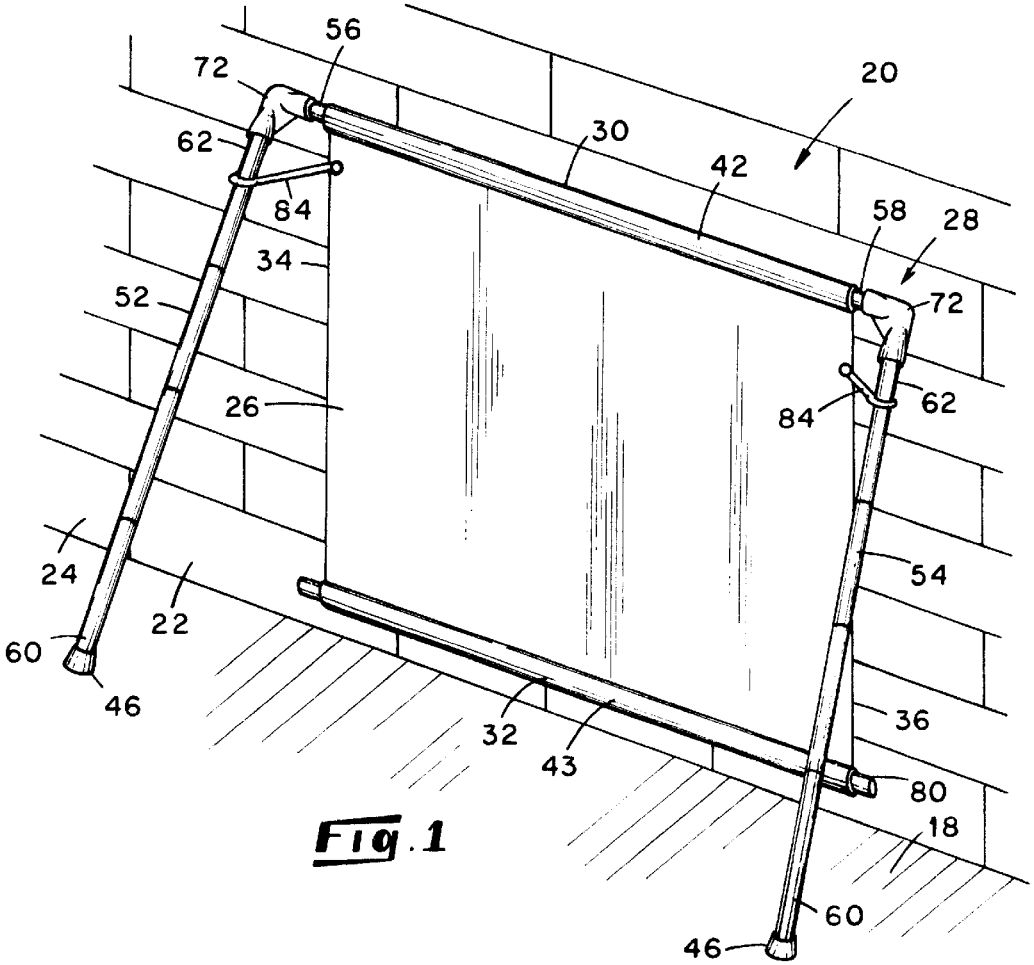
FIG. 1 is a perspective view of an embodiment of a screen system shown operatively positioned adjacent a wall for use.

Turning now to the drawings in greater detail, there is shown in FIG. 1 an embodiment, generally indicated 20, of a screen system within which features of the present invention are embodied and a wall 22 which provides an upstanding, substantially vertical, surface 24 against which the system 20 is positioned and a horizontal floor 18 upon which the weight of the system 24 is supported. The depicted system 20 includes a sheet, indicated 26, of material which provides a surface against which an image can be projected by way of a projector or the like and means, generally indicated 28, providing a frame from which the sheet 26 is suspended. As will be apparent herein, the frame 28 cooperates with the wall surface 24 for supporting the sheet 26 in a spread, substantially vertical condition for use.

In addition, although the depicted embodiment 20 is described herein as being suited for displaying and/or reflecting an image cast thereagainst by way of a projector, a system in accordance with the broader aspects of the invention may be used for supporting alternative image-displaying items, such as a banner or a poster. Accordingly, the principles of the present invention can be variously applied.

Figure 2:
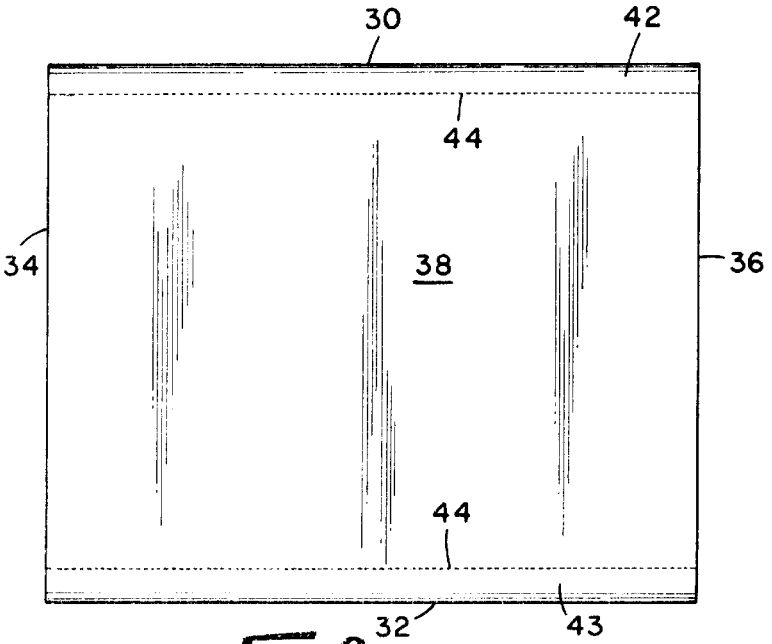
FIG. 2 is a front elevational view of the material sheet of the FIG. 1 system.
Figure 3:
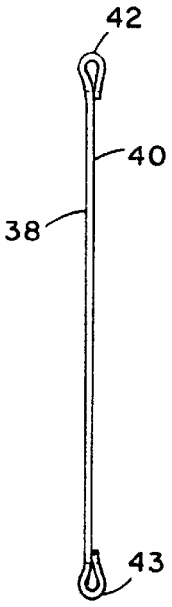
FIG. 3 is a side elevational view of the material sheet of the FIG. 1 system, as seen from the right in FIG. 2.

With reference to FIGS. 2 and 3, the material sheet 26 is generally rectangular in form with two opposite parallel, i.e. upper and lower, edges 30 and 32 and two opposite parallel side edges 34 and 36. The sheet 26 also includes two opposite front and rear faces 38 and 40, respectively. Extending along each of the upper and lower edges 30 and 32 of the sheet 26 is a sleeve-like portion 42 or 43 whose purpose will become apparent herein. Each sleeve-like portion 42 may be formed by folding an edge portion of the material of the sheet 26 back upon itself and stitching a seam 44 in the folded edge portion which extends along the length of the corresponding edge 30 or 32 or, in the alternative, formed as a tube separately from the sheet 26 and joined thereto along a seam.

The material out of which the sheet 26 is constructed may be any of a number of fabric materials, such as cotton or a synthetic fabric which provides the sheet 26 with flexibility to permit it to be arranged into a compact (e.g folded or rolled-up) condition for storage or transport. Since an intended use of the material sheet 26 is to provide a surface against which an image is cast by way of a projector, it is preferable that one face (or in particular, the front face 38) of the material sheet 26 be highly reflective. To this end, the front face 38 of the sheet may be white in color or may be coated with a reflective substance.

As far as the size of the sheet 26 is concerned and in accordance with the intended use of the depicted system 20, the sheet 26 should be large enough to provide a projection screen suitable for group viewing. To this end, it is preferred that the sheet 26 measure at least about six feet in length and about six feet in width, but a sheet having alternative dimensions can be employed.

With reference to FIGS. 4-7, the frame 28 of the system 20 includes a first section 50 which is attachable to the upper edge 30 of the material sheet 26 and two leg sections 52 and 54 which are attachable to the first section 50 for supporting the first section 50 in an elevated position above the floor 18. As will be apparent herein, the leg sections 52 and 54 are joinable to the first section 50 so that the frame 28 is generally U-shaped in form (or more particularly, assumes the form of an inverted U) wherein the first section 50 provides the base of the U of the frame shape and the leg sections 52 and 54 provide the legs of the U of the frame shape.

In this connection, the first section 50 is linear in form and has two opposite ends 56 and 58, and each of the leg sections 52 and 54 includes a foot end 60 and an opposite head end 62 to which a corresponding end 56 or 58 of the first section 50 is connectable. In the depicted system 20, the first section 50 is receivable by the sleeve-like portion 42 extending along the upper edge 30 of the sheet 30 so that its opposite ends 56 and 58 protrude from the opposite side edges of the sheet 26, and the head end 62 of each leg section 52 and 54 is attached to these protruding ends 56 and 58 of the first section 50 to join the sections 50, 52 and 54 together. If desired, each foot end 60 can be capped with an elastomeric foot member 46 (FIG. 1) which resists a sliding of the foot ends 60 relative to and across the floor 18.

To accommodate the collapse of the first section 50 and the leg sections 52 and 54, as well as facilitate the set-up of the frame 28, each of the first and leg sections 50, 52 and 54 include a plurality of hollow (generally cylindrical) linear members 64 arrangeable in an end-to-end fashion and an elastomeric tensioning cord 66 (FIG. 6) which extends through the interior of the members 64. In particular and as exemplified by the first section 50 depicted in FIGS. 5-7, one end of the cord 66 is secured within one end of the linear member 64 arrangeable at one end of the section 50, 52 or 54 and the opposite end of the cord 66 is secured within an end of the linear member 64 arrangeable at the opposite end of the section 50, 52 or 54. The ends of the linear members 64 are preferably interfitted in a male/female relationship to releasably secure the members 64 together, and the tensioning cord 66 is arranged under tension when the linear members 64 are connected in their assembled, end-to-end fashion so that when assembled, the linear members are held together by the combination of the surface-to-surface friction between the interfitted male and female connections of the joined members 64 and the tensioned condition of the cord 66.

Figure 7:
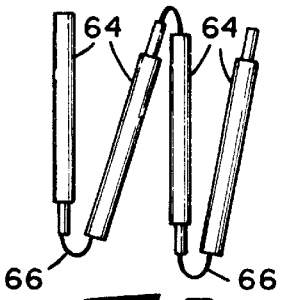
FIG. 7 is a side elevational view of the FIG. 5 section as depicted in FIG. 6, but shown taken apart and collapsed into a compact arrangement.

It follows from the foregoing that the linear members 64 and associated tensioning cord 66 cooperate in a manner similar to collapsible tent posts which include hollow linear sections which are joinable in a end-to-end fashion and maintained in the joined condition by an elastic shock cord which extends through the hollow interiors of the sections. In this regard, the tensioning cord 66 tensions the opposite ends of the arrangement of joined members 64 of each of the frame sections 50, 52 and 54 toward one another so that the members 64 are maintained in the desired end-to-end fashion when assembled and also maintains the members 64 of each section 50, 52 or 54 in a joined condition when disassembled and arranged in somewhat of a side-by-side arrangement as shown in FIG. 7.

To assemble the screen system 20 from a disassembled condition, each of the first and leg sections 50, 52 and 54 is arranged in its desired linear form (as depicted by the section 50 in FIG. 5) so that its members 64 are arranged in the desired end-to-end fashion. The first section 50 is then inserted endwise into the sleeve-like portion 42 (FIGS. 1 and 2) which extends along the upper edge 30 of the material sheet 26 so that the opposite ends 56 and 58 protrude from the opposite ends of the sleeve-like portion 42. The head end 62 (FIG. 1) of each leg section 52 or 54 is then joined to the corresponding protruding end 56 or 58 of the first section 50 (in a manner described herein) to connect the leg sections 52 and 54 to the first section 50.

Figure 4:
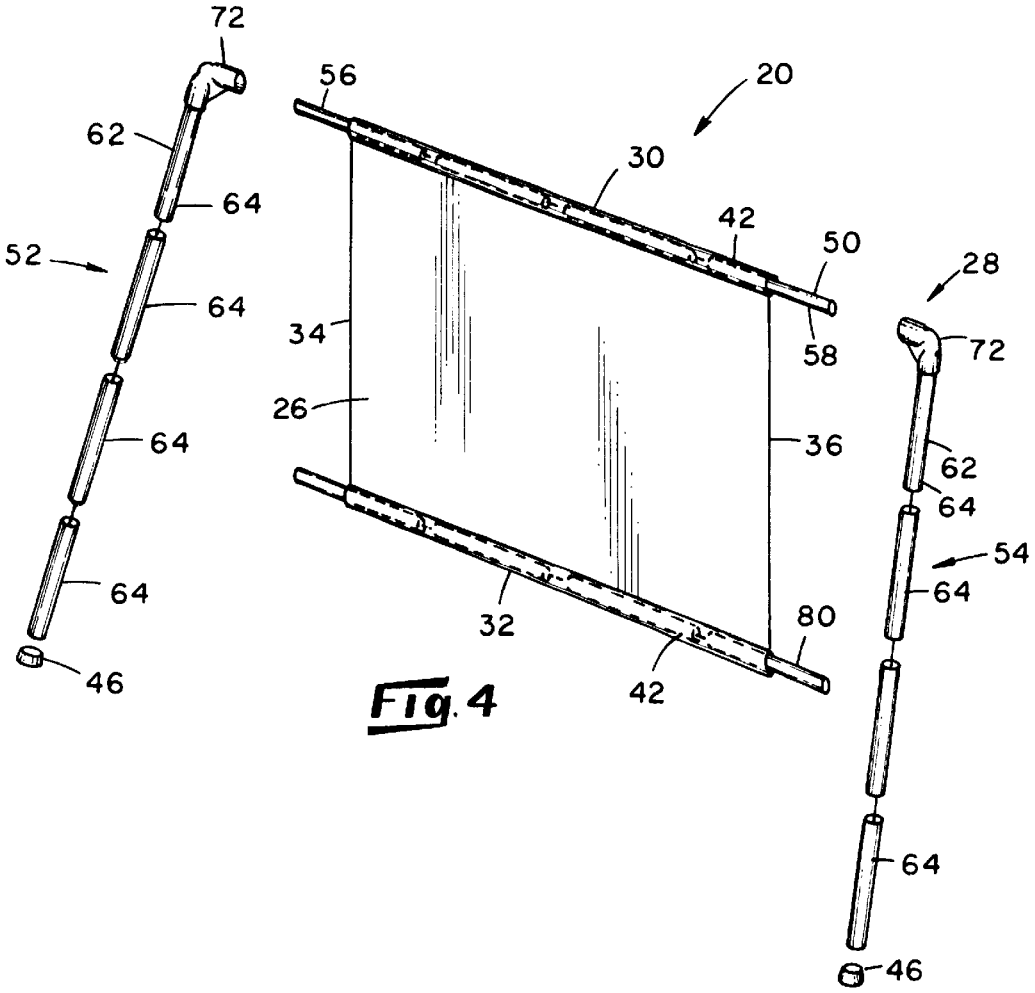
FIG. 4 is a perspective view of the FIG. 1 system similar to the view of FIG. 1, but shown exploded.
Figure 5:
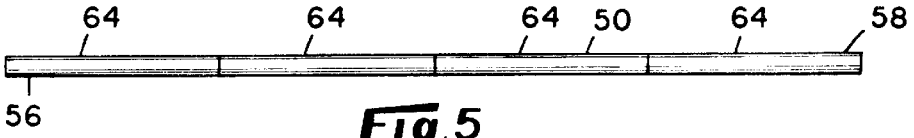
FIG. 5 is a side elevational view of a section of the frame of the FIG. 1 system.
Figure 6:
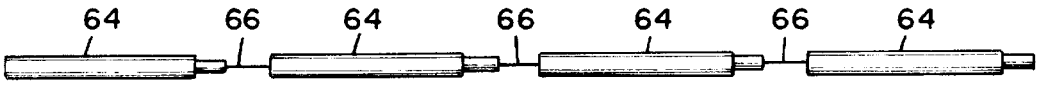
FIG. 6 is a side elevational view of the FIG. 5 frame section as depicted in FIG. 5, but shown exploded.
Figure 8:
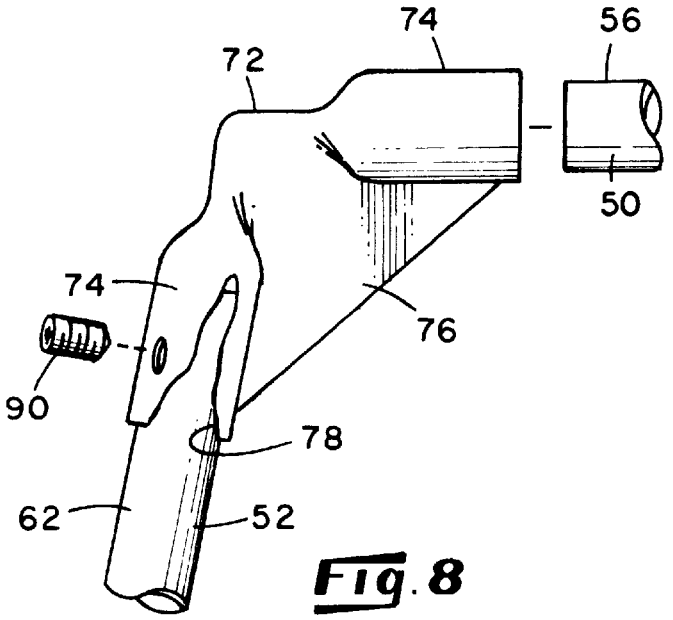
FIG. 8 is a front elevational view of a fragment of the frame of the FIG. 1 system, shown exploded and shown partially cut-away.
Figure 9:
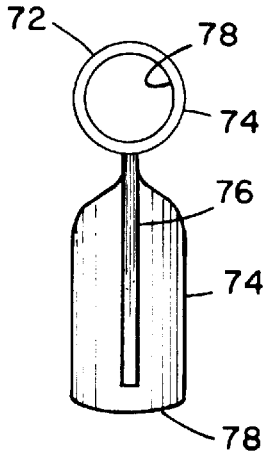
FIG. 9 is a side elevational view of one of the components depicted in FIG. 8 as seen generally from the right in FIG. 8.

For purposes of joining the leg section ends 62 to the first section end 56 or 58, there is illustrated in FIG. 4, two brackets 72 (one of which is shown in FIGS. 8 and 9) wherein each bracket 72 has two recessed portions 74 arranged in an angular relationship and joined by a gusset portion 76 which holds the recessed portions 74 in stationary relationship with respect to one another. Each recess portion 74 has a circular recess 78 which is adapted to snugly accept the head end 62 or the protruding end 56 or 58 of the sections 50, 52 or 54 when inserted therein. To use the brackets 74 and with reference to FIG. 4, each of the leg section ends 62 and the protruding end 56 or 58 is inserted endwise within a corresponding recess 78 of the bracket 72 so that each of the leg sections 52 and 54 are maintained in an angular relationship with the first section 50. In the depicted system 20, each of the leg sections 52 or 54 forms an angle with the first section 50 which is slightly greater than about 90° (e.g. about 95°). Preferably, each bracket 72 is fixedly secured to a corresponding leg section 52 or 54 with, for example, a set screw 90 (FIG. 8) to join the bracket 72 and one leg member 64 of each leg section 52 or 54 as a single unit.

Figure 10:
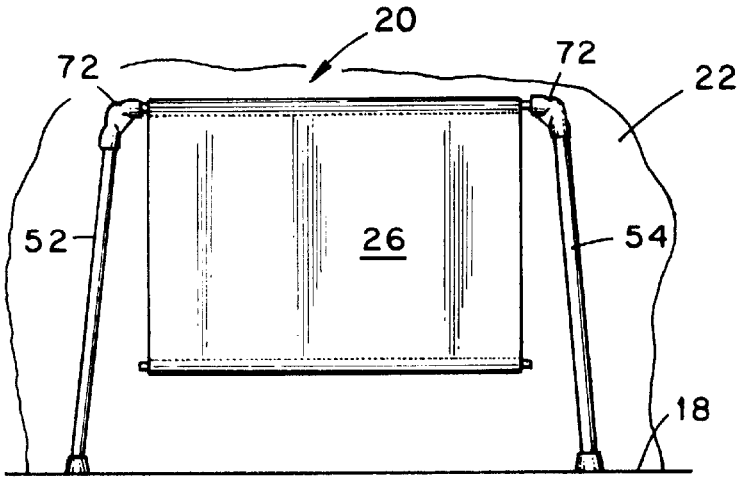
FIG. 10 is a front elevational view of the FIG. 1 system.
Figure 11:
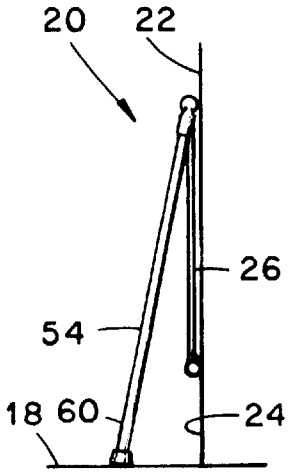
FIG. 11 is a side elevational view of the FIG. 1 system as seen generally from the right in FIG. 10.

The assembled system 20 is then positioned adjacent the wall 22 as shown in FIGS. 10 and 11 so that the feet ends 60 of the leg sections 52 and 54 rest upon the floor 18 and the first section 50 (with the material sheet 26 suspended therefrom) is arranged in a generally horizontal disposition and parallel to the surface of the wall 22. As best shown in FIG. 11, the foot ends 60 of the leg sections 52 and 54 are spaced from the wall 22 by a short distance (e.g. between 1.0 and 2.0 feet). The system 20 is then leaned against the wall 22 as the first section 50 pivots about the foot ends 60 of the leg sections 52 and 54 until the first section 50 comes to rest against the wall 22.

It follows that as the first section 50 is rested against the wall 22 as aforedescribed, the material sheet 26 is suspended vertically from the first section 50 under its own weight in a spread, flattened condition under its own weight. In addition, since the first section 50 is positioned adjacent the wall 22 as it is rested thereagainst, the suspended material sheet 26 is backed by the surface 24 of the wall 22 which, in turn, helps to maintain the sheet 26 in a desired spread condition. If desired and with reference again to FIGS. 1 and 2, an additional collapsible section 80 having a construction identical to that of the first section 50 can be provided for insertion within the sleeve-like section 43 extending along the lower edge 32 of the material sheet 26 to provide additional weight to the sheet edge 32. The addition of the weight of the added section 80 helps to take out wrinkles or similar imperfections which may otherwise be present in the sheet 26.

Figure 12:
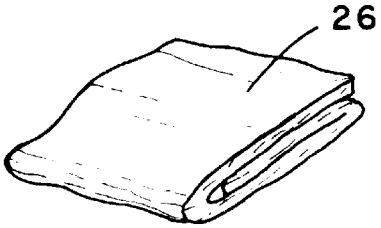
FIGS. 12 and 12*a* are perspective views of the material sheet shown in FIG. 2, but shown in either a folded or rolled-up arrangement for transport or storage.
Figure 12A:
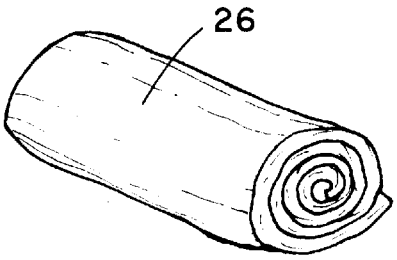

To disassemble the system 20, the leg sections 52 and 54 are removed from the opposite ends of the first section 50 by removing the brackets 74 from the ends 56, 58 of the first section 50. The first section 50 and additional section 80, if present, are then removed from the sleeve-like portions 42 of the sheet 26. With the aforedescribed components separated from one another, each of the first and leg sections 50, 52 and 54 (and additional section 80, if present) are broken down to arrange the linear members thereof in a relatively compact arrangement as depicted by the section 50 in FIG. 7 and the sheet 26 is folded to a small, compact square arrangement as shown in FIG. 12 or is rolled into a rolled-up compact, arrangement as shown in FIG. 12*a*. The compact arrangement of the sections 50, 52, 54 and 80 and material sheet 26 can then be packed within a relatively small container, such as a briefcase, for transport or storage. To this end, none of the linear members 64 of the sections 50, 52 or 54 have a length which exceeds about 3.0 feet, and preferably, the length of the sections 50, 52 or 54 do not exceed about 2.0 feet. In addition, the collective weight of the system components is less than about ten pounds (preferably about five pounds) to render the system 20 relatively light in weight, and the depicted system 20 can be collapsed into an arrangement which is can be fitted into a rectangular compartment whose volume measures about three feet by six inches by six inches.

In addition to the compact nature of the system 20 when disassembled and folded and/or rolled up as aforedescribed, the system 20 is also advantageous in that it requires relatively little floor space for use. In fact, since the sheet 26 is relatively flush with the surface 24 of the wall 22 when set up for use (as depicted in FIG. 11) and the foot ends 60 of the leg sections 52 and 54 extend away from the wall 22 only a short distance, the structure of the system 20 renders the system 20 well-suited for applications, such as at a trade show booth, where floor space is typically limited. In any event, the amount of floor space required by the system 20 during use is smaller than that normally required by conventional screens having a set of tripod legs, and the system 20 is advantageous in this respect.

It will be understood that numerous modifications and substitutions can be had to the aforedescribed embodiment without departing from the spirit of the invention. For example, if desired, elastomeric cords 84 (shown in FIG. 1) can be secured in a tensioned condition between each leg section 52 or 54 and a corresponding edge 34 or 36 of the sheet 26 to hold the edges 34 and 36 in a laterally-spaced relationship.

Figure 13:
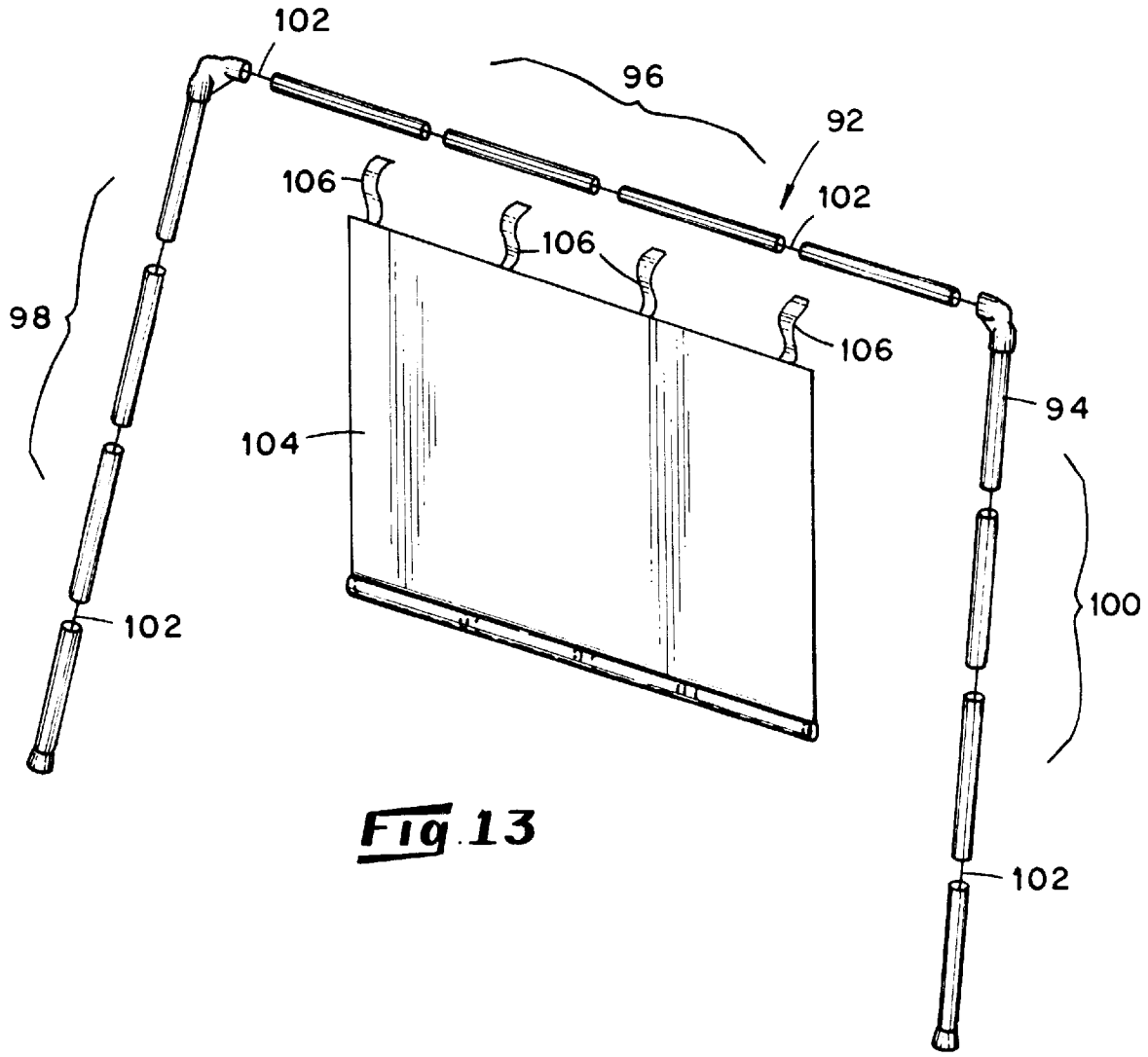
FIG. 13 is a view similar to that of FIG. 4 of an alternative embodiment of a display system within which features of the present invention are embodied.

Furthermore, although the frame 28 of the system 20 of FIGS. 1–11 has been shown and described as including leg sections 50, 52 and 54 which employ separate tensioning cords 66, a frame of a system embodiment may employ an alternative arrangement of tensioning cords. For example, there is shown in FIG. 13 a system embodiment, generally indicated 92, including a frame 94 having collapsible sections 96, 98 and 100 which are joinable together in the form of an inverted U and wherein the frame 94 utilizes a single tensioning (e.g. shock) cord 102 which extends completely through the joined sections 96, 98 and 100 from the foot end of one (leg) section 98 to the foot end of the other (leg) section 100. This single-cord arrangement of the frame 94 may be preferred over the frame 28 of the system 20 of FIGS. 1–11 to reduce the total number of components of the system frame which are completely separable from one another.

Still further and with regard again to the system 20 of FIGS. 1–11, to circumvent the need to direct the sleeve-like portion 42 of the material sheet 26 endways over the horizontally-disposed section of the frame 28 to permit the suspension of the sheet 26 from the frame 28, a material sheet, such as the material sheet 104 of the FIG. 13 system 92, can be substituted for the sheet 26. The sheet 104 of FIG. 13 is provided with hook and loop-type fastener strips 106 which are available, for example, under the trade designation Velcro for attachment to the horizontally-disposed section 96 by looping and affixing the strips 106 about the section 96.

Accordingly, the aforedescribed embodiment is intended for the purpose of illustration and not as limitation.

I claim:

1. A display system positionable upon a floor for use with a vertical support surface comprising:

a sheet of material;

a collapsible frame from which the sheet of material is suspended in a spread condition for use, the frame including a horizontally-disposable section having two opposite ends and a pair of leg sections which are connectable to the horizontally-disposable section at the opposite ends thereof so as to extend generally downwardly therefrom and to provide a corner of the frame at each end of the horizontally-disposable section; and the sheet of material is attachable to the horizontally-disposable section of the frame so that by attaching the sheet of material to the horizontally-disposable section, positioning the leg sections of the frame upon the floor adjacent the vertical support surface and then leaning the horizontally-disposable section to a position of rest against the vertical support surface, the sheet of material which is attached to the horizontally-disposable section is suspended therefrom in a spread condition adjacent the vertical surface;

wherein each of the leg sections and the horizontally-disposable section of the frame includes a plurality of linear members which are releasably connectable to one another in an end-to-end arrangement to provide two opposite ends and a common elastomeric tensioning cord which joins the linear members of the leg sections and the horizontally-disposable section together, each of the linear members of the leg sections and the horizontally-disposable section has a hollow interior and the common elastomeric tensioning cord extends through the hollow interiors of the linear members to accommodate the pulling apart of connected linear members during disassembly of the leg sections and re-arrangement of the linear members in a side-by-side relationship for storage and handling; and the frame further includes two corner brackets for joining the horizontally-disposable section to the leg sections at the corners of the frame, each corner bracket including two recessed portions adapted to accept an end of the horizontally-disposable section and end of a corresponding leg section so that by inserting an end of the horizontally-disposable section and an end of a corresponding leg section into the recessed portions, the horizontally-disposable section and the corresponding leg section are joined together and fixedly maintained in an angular relationship which is slightly greater than about 90°, and wherein the recessed portions of each corner bracket are in communication with one another to accommodate the free passage therethrough of the tensioning cord from one recessed portion of the corner bracket to the other recessed portion of the corner bracket; and wherein the common elastromeric tensioning cord extends in sequence through the hollow interiors of the linear members of one of the leg sections, then through one corner bracket of the frame, then through the hollow interiors of the linear members of the horizontally-disposable section, then through the other corner bracket of the frame, and then through the hollow interiors of the linear members of the other of the leg sections so that when the frame is assembled, the common elastomeric cord urges each end of the horizontally-disposable section toward the corresponding end of the leg section through a corresponding corner bracket of the frame.

2. The display system as defined in claim 1 wherein the sheet of material is adapted to be rolled or folded into a small, relatively compact arrangement when detached from the horizontally-disposable section and none of the linear members of the leg sections is greater than about 3.0 feet in length.

3. The display system as defined in claim 2 wherein the frame is generally U-shaped in form having two legs and a base, and the leg sections of the frame are provided by the legs of the U of the shape, and the horizontally-disposable section is provided by the base of the U.

4. The display system as defined in claim 1 wherein each of the linear member of the leg sections and the horizontally-disposable section has a length which is no greater than about 3.0 feet.

5. The display system as defined in claim 4 wherein the sheet of material includes an edge and a sleeve-like portion which extends along said edge, and the horizontally-disposable section is receivable by the sleeve-like portion for attachment of said edge of the material sheet along the horizontally-disposable section of the frame.

6. The display system as defined in claim 1 wherein the sheet material includes a first edge which is attachable to the horizontally-disposable section of the frame, and the sheet of materila includes a second edge opposite the first edge which is suspended generally below the first edge when the horizontally-disposable section is leaned to a position of rest aganist the vertical support surface as aforesaid, and the system further includes means associated with the second edge for supplementing the weight of the second edge.

* * * * *